United States Patent [19]

Bamberg

[11] 4,195,251

[45] Mar. 25, 1980

[54] HIGH INTENSITY DISCHARGE LAMP HAVING SAFETY DEVICE WITH PYROPHORIC MATERIAL

[75] Inventor: William I. Bamberg, Medford, Mass.

[73] Assignee: GTE Sylvania Incorporated, Stamford, Conn.

[21] Appl. No.: 917,993

[22] Filed: Jun. 22, 1978

[51] Int. Cl.[2] ..... H01J 17/34

[52] U.S. Cl. ..... 315/73; 337/401

[58] Field of Search ..... 315/73, 74; 337/401, 337/300, 405, 413, 416

[56] References Cited

U.S. PATENT DOCUMENTS

| | | | |
|---|---|---|---|
| 4,013,919 | 3/1977 | Corbley | 315/74 X |
| 4,013,920 | 3/1977 | Petro | 315/74 X |
| 4,032,816 | 6/1977 | Rokosz | 315/73 |
| 4,090,105 | 5/1978 | Koo | 315/74 |

FOREIGN PATENT DOCUMENTS

| | | | |
|---|---|---|---|
| 267753 | 7/1970 | U.S.S.R. | 315/73 |

*Primary Examiner*—Alfred E. Smith
*Assistant Examiner*—Charles F. Roberts
*Attorney, Agent, or Firm*—James Theodosopoulos

[57] ABSTRACT

A high intensity arc discharge lamp has an arc tube the emission of which includes some harmful UV radiation. An outer envelope surrounds the arc tube and substantially blocks the harmful UV radiation. The lamp includes means to render the arc tube inoperative when the outer envelope becomes cracked or punctured sufficiently to admit air therewithin, the means including a pyrophoric material to initiate combustion of a current carrying portion of the lamp circuit.

3 Claims, 2 Drawing Figures

HIGH INTENSITY DISCHARGE LAMP HAVING SAFETY DEVICE WITH PYROPHORIC MATERIAL

THE INVENTION

This invention relates to high intensity arc discharge (HID) lamps of the type having an arc tube within an outer envelope, the arc tube emission including some UV radiation. The outer envelope is generally made of a glass, such as nonex, that blocks passage of harmful UV radiation. This invention is particularly related to such lamps having a safety device to terminate arc tube current when the outer envelope is broken. Examples of such lamps are shown in U.S. Pat. Nos. 4,013,920 and 4,032,816. However, the mechanically operated safety devices in said patents are not activated by a puncture, say, about 1.0 cm in diameter, in the outer envelope that leaves the rest of the envelope intact. Another type is shown in U.S. Pat. No. 4,013,919 in which a normally closed switch is at an elevated temperature during normal operation but cools off and opens when the outer envelope is broken, thereby passing the arc tube current through a fuse heater which oxidizes in the presence of air and opens the circuit. A problem with this lamp is that the switch can take a thermal set after several thousand hours of operation and not open when the outer envelope breaks. Still another type, such as in U.S. Pat. No. 4,090,105, has a fuse heater in series with the arc tube and which operates at a high enough temperature, for example, at incandescence, to oxidize rapidly in the presence of air and open the circuit. This device wastes $I^2R$ power.

A purpose of this invention is to overcome the disadvantages of the prior art lamps. A lamp in accordance with this invention utilizes a pyrophoric conductor electrically in series with the arc tube. Upon exposure to air, the conductor ignites at a relatively low temperature and opens the arc tube circuit. In one embodiment, the pyrophoric conductor comprises a yarn of loosely wound filaments of a combustible metal coated with a powdered reaily ignitable material.

Figure 1:
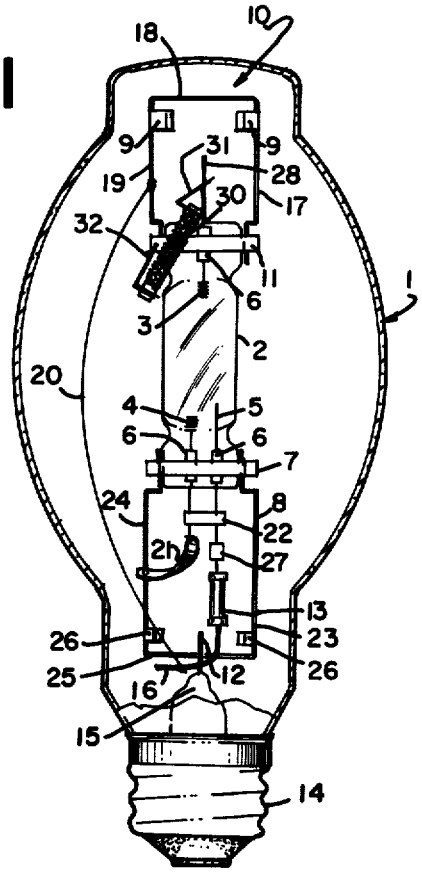

FIG. 1 in the drawing is a perspective view of an HID lamp in accordance with this invention.

Figure 2:
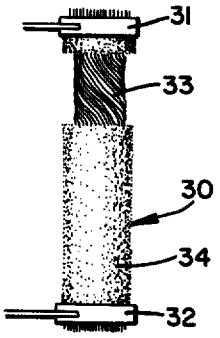

FIG. 2 is an expanded sectional view of a pyrophoric conductor.

As shown in the drawing, one example of a lamp in accordance with this invention includes a generally tubular outer bulbous envelope 1 having a bulbous central portion and a conventional base 14 attached to the bottom thereof. Extending inwardly from the base and inside of the envelope 1 is a mount 15 having a pair of stiff lead-in wires 12 and 16 in electrical conducting relation with the base 15. Disposed upon one of the stiff lead-in wires 12 is a lower, U-shaped support 8 welded thereto. U-shaped support 8 comprises a pair of vertical wires 23 and 24 rising from a horizontal base wire 25. The upper ends of lower U-shaped support 8 are welded together with a lower strap 7 which in turn supports an arc tube 2. Preferably, the lower strap includes two sections abutting against either side of arc tube 2 thereby holding it firmly in place. They touch only the press seal of the arc tube and not the body. Generally, both sides of the lower strap 7 can be of identical constuction. A pair of bumpers 26 are welded to lower U-shaped support 8 and abut against the tubular portion of walls of outer bulbous envelope 1 thereby stabilizing the structure within the lamp. Preferably, these bumpers are made of a reslient material so that if the lamp is jarred they will absorb much of the shock.

Since lower U-shaped support 8 is electrically connected to stiff lead-in wire 12, support 8 forms part of the circuit in the device. Current passes from base 14 into lower U-shaped support 8 and thence to lead-in wire 21 which in turn is connected to a cathode 4 in the arc tube. It is sometimes desirable to place an insulating shield about lead-in wire 21 to prevent arcing within the lamp and between the various elements. Current passes from lead-in wire 21 to cathode 4 through an intermediary molybdenum foil section 6.

The other side of the circuit is formed through stiff lead-in wire 16 which is preferably bent out of place so that parts on one side of the line are insulated from those on the other side. A resistor 13 is attached to stiff lead-in wire 16 through a lead-in wire associated therewith and thence to a connector 27 which is attached to starting probe 5. Bimetal 22 is biased open when the lamp is turned off but when the lamp starts, it biases closed against the lead-in to probe 5 thereby establishing the same current potential at probe 5 and cathode 4. Such closing prevents electrolysis between the probe and cathode.

At the other end of arc tube 2, an upper support 10 is mounted within the tubular portion of bulbous envelope 1. Support frame 10 includes a horizontal section 18 having vertical supports 17 and 19 depending downwardly therefrom and attached at the free ends to an upper strap 11 which surrounds the press seal of arc tube 2 and rigidly holds it in place. Preferably, the construction and disposition of upper strap 11 is similar to lower strap 7. A pair of upper bumpers 9 are mounted upon vertical sections 17 and 19 of upper support 10 and resiliently abut against the sides of the tubular portion of bulbous envelope 1. Such disposition prevents breakage of the lamp if the arc tube is shaken or dropped.

A lead-in wire 28 extends to the outside or arc tube 2 and is attached at its inner end to a molybdenum foil section 6 and thence to a cathode 3. A pyrophoric conductor 30 is electrically connected in series between cathode 3 and lead-in wire 16. Pyrophoric conductor 30 is physically connected between lead-in wire 28 and upper strap 11 by means of support wires 31 and 32. Electrical connection to upper cathode 3 is established by a thin conducting wire 20 connected at its lower end to lead-in wire 16 and at its upper end to vertical support 19 which is connected to upper strap 11. Support wire 32 is connected to upper strap 11 and support wire 31 is connected to lead-in wire 28.

In one example, pyrophoric conductor 30 was made by twisting together loosely about a hundred filaments 33 of 1" to 2" long shredded aluminum foil of the type used as the combustible material in photoflash lamps. The ends of the loose yarn formed were clamped in support wires 31 and 32. The yarn was then coated with a slurry of finely powdered zirconium metal dispersed in water, the powdered zirconium being, for example, of the type used as a primer in photoflash lamps. The powdered zirconium 34 easily penetrated into the loose yarn. After drying, the zirconium was securely retained in pyrophoric conductor 30.

Pyrophoric conductor 30 should have sufficiently low electrical resistivity so that there are substantially no $I^2R$ losses therein during normal lamp operation. Conductor 30 also should be sufficiently pyrophoric so that it will spontaneously ignite in the presence of air at a relatively low temperature, say, at or somewhat above room temperature.

In operation, pyrophoric conductor 30 is mounted in a lamp so that it is maintained, during normal lamp operation, at a temperature above its ignition temperature. In the example shown in the drawing, a 400 watt lamp, the temperature of conductor 30 during normal lamp operation was about 200° C. to 250° C. The fill inside jacket 1 is either a vacuum or an inert gas. When jacket 1 cracks or breaks, and admits air, the powdered zirconium of conductor 30 spontaneously ignites and generates sufficient heat to ignite the aluminum filaments. In a short time, the aluminum is consumed and the circuit is opened.

Examples of other combustible metals which will burn readily in air if heated sufficiently and which can carry the lamp current are magnesium, zirconium and scandium.

I claim:

1. In a high intensity arc discharge lamp of the type having an arc tube within an outer envelope which contains either a vacuum or an inert gas, the improvement which comprises means to render the arc tube inoperative when the outer envelope is damaged sufficiently to admit air therewithin, said means comrpising a pyrophoric conductor electrically in series with the arc tube, said pyrophoric conductor being of the type that will spontaneously ignite in the presence of air at a temperature somewhat above room temperature, said pyrophoric conductor comprising a yarn of loosely wound filaments of a combustible metal coated with a powdered reaily ignitable material.

2. The lamp of claim 1 wherein said combustible metal consists of aluminum, magnesium, zirconium or scandium.

3. The lamp of claim 1 wherein said powdered readily ignitable material is zirconium.

* * * * *